United States Patent [19]

Guibert

[11] Patent Number: 4,702,474

[45] **Date of Patent: * Oct. 27, 1987**

[54] ARTICULATED HAND-HELD EXERCISE

[76] Inventor: Raul Guibert, 87 Stratton Forest Way, Simsbury, Conn. 06070

[ * ] Notice: The portion of the term of this patent subsequent to Dec. 10, 2002 has been disclaimed.

[21] Appl. No.: 800,960

[22] Filed: Nov. 22, 1985

Related U.S. Application Data

[63] Continuation-in-part of Ser. No. 627,663, Jul. 3, 1984, Pat. No. 4,557,479.

[51] Int. Cl.[4] ..... A63B 11/00

[52] U.S. Cl. ..... 272/122; 272/67; 272/117; 272/137

[58] Field of Search ..... 272/67, 117, 122–124, 272/128, 136–137, 140, 143

[56] References Cited

U.S. PATENT DOCUMENTS

| | | | |
|---|---|---|---|
| 605,747 | 6/1898 | Sachs et al. | 272/117 |
| 2,233,764 | 3/1941 | Bauermeister | 272/140 X |
| 2,356,260 | 8/1944 | Maxwell | 272/136 |
| 2,529,347 | 11/1950 | Mohler et al. | 272/137 |
| 2,714,008 | 7/1955 | Urban | 272/137 |
| 2,855,199 | 10/1958 | Noland et al. | 272/117 |
| 3,451,675 | 6/1969 | Burzenski | 272/137 |
| 4,006,895 | 2/1977 | DiLaurenzio | 272/67 |
| 4,328,964 | 5/1982 | Walls | 272/136 |
| 4,557,479 | 12/1985 | Guibert | 272/128 X |

*Primary Examiner*—Richard J. Apley
*Assistant Examiner*—Robert W. Bahr
*Attorney, Agent, or Firm*—Michael Ebert

[57] ABSTRACT

An articulated hand-held exerciser constituted by left and right-hand weighted clubs having replaceable handles which simulate the grip of a standard handled sports appliance such as a tennis racquet. The ends of the clubs are hinged together by a spring or other means so that the clubs, when held by a user, may be more or less angled and the exerciser is capable of executing both simple and complex motions. These bring into play and develop the muscles of the muscular system associated with the shoulders, arms and wrists of the user, the same muscles which are involved when using the sports appliance.

6 Claims, 13 Drawing Figures

Fig. 4.
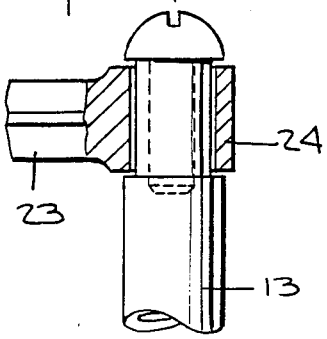
Fig. 11.
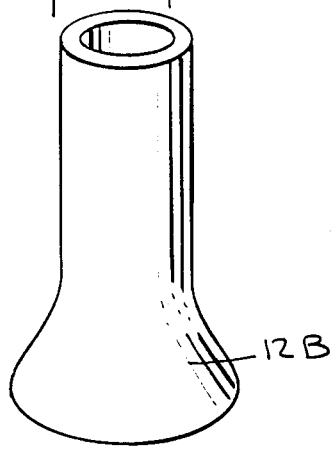
Fig. 6.
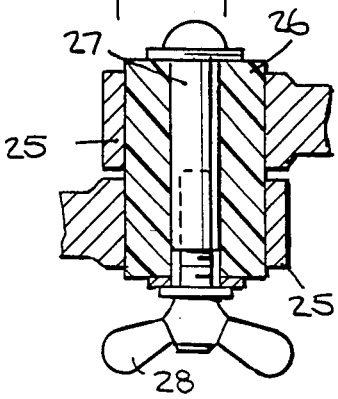
Fig. 8.
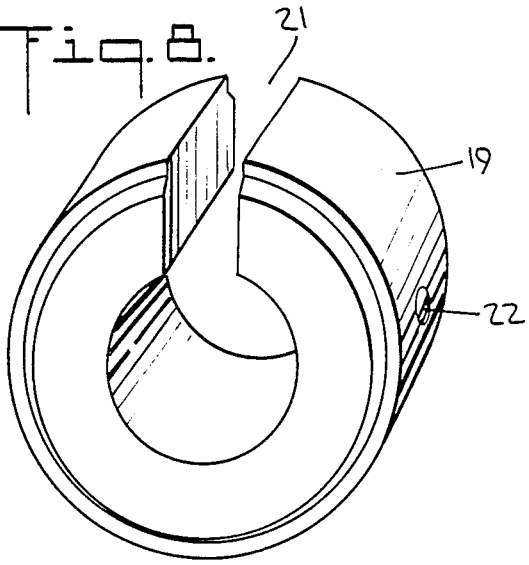
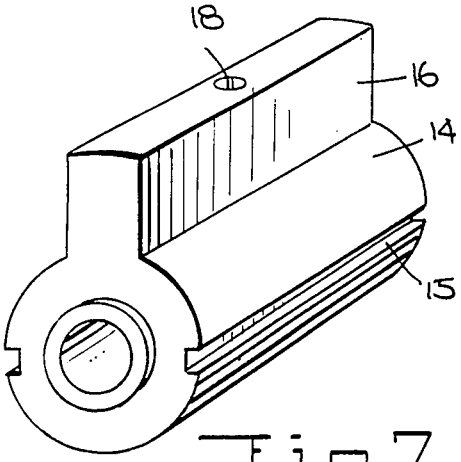
Fig. 7.
Fig. 12.
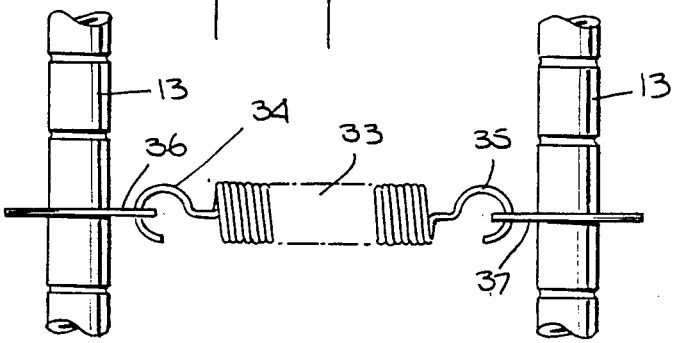
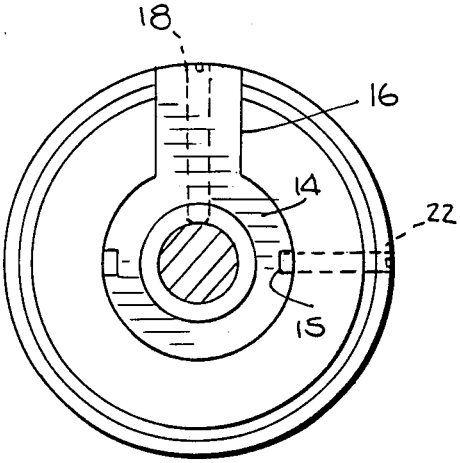
Fig. 9.

ARTICULATED HAND-HELD EXERCISE

RELATED APPLICATION

This case is a continuation-in-part of my copending application Ser. No. 627,663, filed 7/3/84, entitled "Articulated Manual Exercise Bar," whose entire disclosure is incorporated herein by reference now U.S. Pat. No. 4,557,479.

BACKGROUND OF INVENTION

1. Field of Invention

This invention relates generally to manual exercisers suitable for athletic or therapeutic purposes, and more particularly to an articulated exerciser formed by left and right hand weighted clubs hinged together at their ends, the exerciser when held by the hands of a user being capable of undergoing both simple and complex motions which bring into play and develop many of the muscles in the muscular system associated with the user's shoulders, arms and wrists which are uninvolved in conventional hand-held exercisers.

2. Status of Prior Art

In contemporary society, large-scale mechanization has sharply reduced the need for an expenditure of physical energy in the production of goods and services. Indeed, the aim of the typical invention is to provide a labor-saving device to supplant human effort. But while modern man has been relieved of the Biblical injunction to earn his daily bread by the sweat of his brow, this has been a mixed blessing; for the resultant inactivity has given rise in affluent societies to serious obesity problems and has impaired the ability of many persons to carry out normal physical tasks with a reasonable degree of efficiency.

To remediate many of the physical fitness problems of the sedentary individual, various forms of exercisers have been contrived that are designed to develop muscular strength and endurance. By muscular strength is meant the measurable strength of muscles as determined by a single maximum contraction, and by muscular endurance is meant the ability of muscles to perform work for a given time period.

Muscles consist of many fibers held together by connective tissue and having the power to contract and relax and thereby perform the movement and the vital processes of the organism. The voluntary of striated muscles which are subject to the human will and control the body are attached by tendons to the skeleton. They constitute much of the body weight and appear as lean flesh.

Muscular power represents the ability to release maximum muscular force in the shortest time. Muscular strength is the strength of muscles as determined by a single maximum contraction, while muscular endurance is the ability of muscles to perform work for a given period of time. One may develop muscular power, strength and endurance by the use of bar bells, but the manipulation of bar bells up and down and sideways does not engage all of the shoulder and neck muscles as well as the arm and wrist muscles, and may therefore result in uneven development.

Also in popular use are Indian clubs which are shaped like a large bottle or a ten pin and are swung about with one in each hand, mainly to strengthen the muscles of the arms. It is known (see U.S. Pat. No. 64,081–1867) to provide such clubs with adjustable weights which are axially shiftable along the club to change the moment of inertia of the club and hence the muscular strength required to manipulate the club. But the manipulation of Indian clubs has limited exercise value for the same reasons given in regard to bar bells.

Another drawback of Indian clubs, which are provided with cylindrical handles of uniform diameter, is that these handles do not afford a grip corresponding to that of a standard handled sports appliance such as the grip of a tennis racquet, a golf club, a baseball bat or a rowing oar.

A tennis player, for example, in order to strengthen those muscles which are primarily involved in this game, should use a hand-held exerciser which has the same grip as his racquet and is capable of executing similar movements, for then the resultant muscular development will be compatible with the requirements of the game. If, therefore, the tennis player uses conventional bar bells or Indian clubs to develop his muscles, the resultant muscular development will not be compatible with the muscles called into play when the exerciser later switches to his racquet.

SUMMARY OF INVENTION

In view of the foregoing, the main object of this invention is to provide an articulated hand-held exerciser which brings into play a spectrum of dynamic tensions acting to develop the entire muscular system associated with the shoulder, arms and wrists of the user.

More particularly, an object of the invention is to provide an articulated exerciser formed by a pair of weighted left and right-hand clubs which are so hinged together that the user holding the clubs by their handles is able to execute highly complex as well as relatively simple motions.

A significant feature of the invention is that the handles of the exerciser are shaped to simulate the grip of a particular sports appliance such as a tennis racquet, and are replaceable so that the user can attach handles to the exerciser which correspond to any handled sports appliance and thereby develop the appropriate muscles. Thus the exerciser has the characteristics and the feel of the sports appliance and is fully compatible therewith.

Briefly stated, these objects are attained in an articulated hand-held exerciser constituted by left and right-hand clubs formed by shafts having replaceable tubular handles which are shaped to simulate the grip of a standard handled sports appliance. The ends of these shafts are hinged together by a helical spring or other means whereby the user, when gripping the handles, may hold them in parallel relation and then more or less angle the clubs with respect to the hinge.

Slidable on each shaft is a carrier whose position may be set at any desired axial position, the corner accommodating at least one removable weight to create a mass whose axial position determines the club's moment of inertia.

When the user grasps the handles, he can then execute simple motions in which the clubs are generally parallel and are swung up and down in an arc or from side to side, and he can also execute a more complex motion in which the clubs are angled to create a space between the hands and arms so that the user can then precess his wrists to rotate the exerciser in this space. These simple and complex motions act to develop those muscles which come into play when using a handled sports appliance.

OUTLINE OF DRAWINGS

For a better understanding of the invention as well as other objects and further features thereof, reference is made to the following detailed description to be read in conjunction with the accompanying drawings, wherein:

FIG. 4 shows the coupling between one end of a club and its lateral extension;

FIG. 6 is a section taken through the hinge;

FIG. 7 is a perspective view of the weight carrier;

FIG. 8 is a perspective view of one of the weights;

FIG. 9 is an end view of the weight when it is mounted on the carrier;

FIG. 10 is a longitudinal section taken through the

FIG. 11 shows an alternate form of handle;

FIG. 12 shows an exerciser with a spring bridging the clubs ; and

DESCRIPTION OF INVENTION

The Structure

Figure 1:
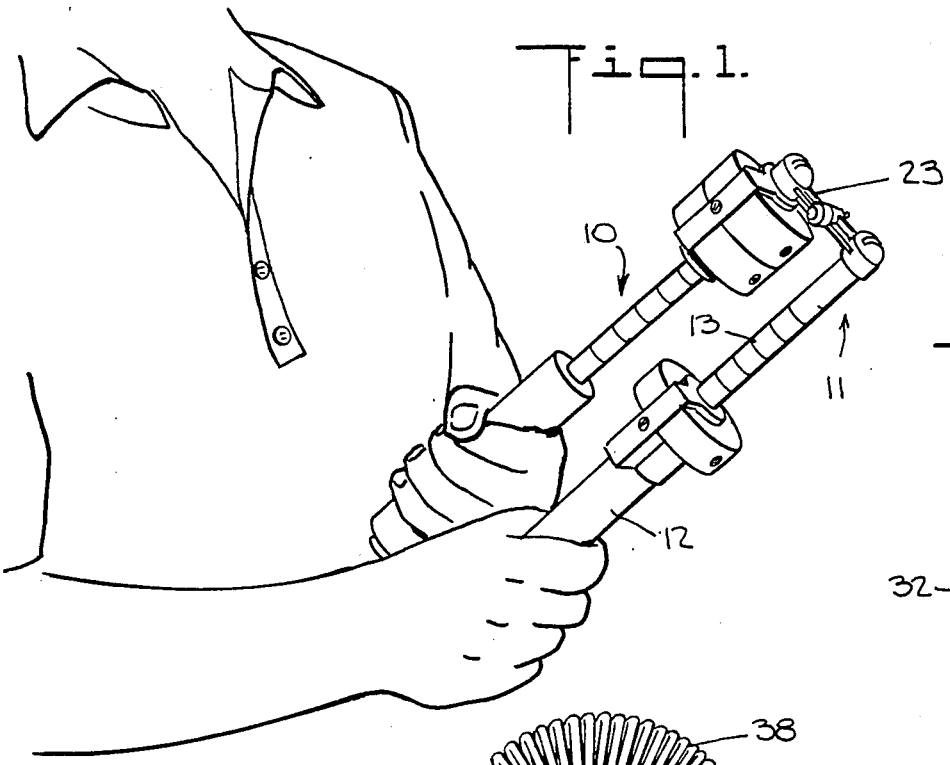
FIG. 1 is a perspective view of an articulated exerciser in accordance with the invention which the user holds the clubs so that they are almost in parallel relation.

Referring now to FIG. 1, there is shown an articulated exerciser in accordance with the invention, the exerciser being constituted by left and right-hand clubs, generally designated by numerals 10 and 11, the clubs each being provided with a replaceable tubular handle 12.

Figure 2:
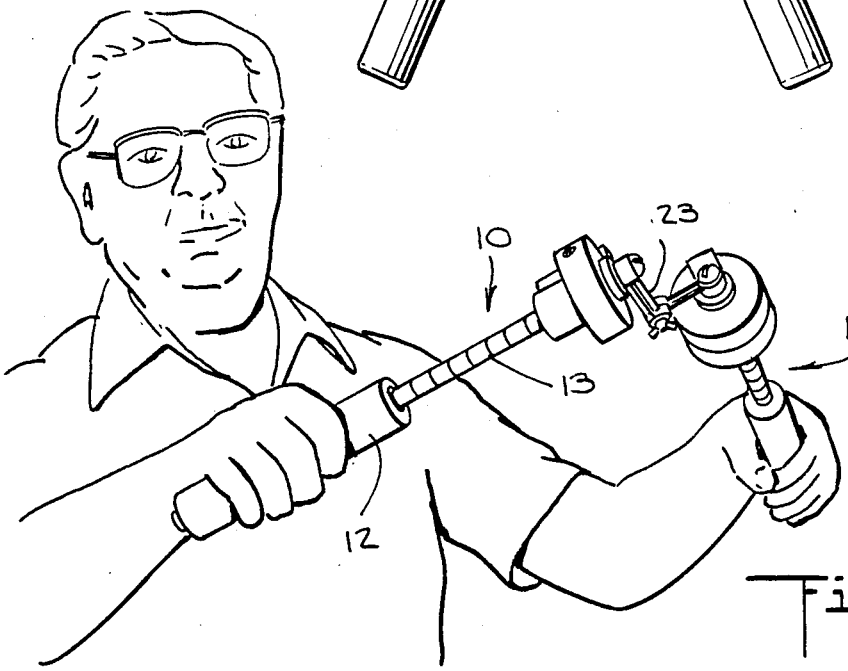
FIG. 2 shows the exerciser when it is held so as to angle the clubs.

The ends of the clubs are provided with lateral extensions which are hinged together so that the user who grasps the handles can hold the clubs in parallel relation, as shown in FIG. 1, or angled with respect to the hinge, as shown in FIG. 2.

Figure 3:
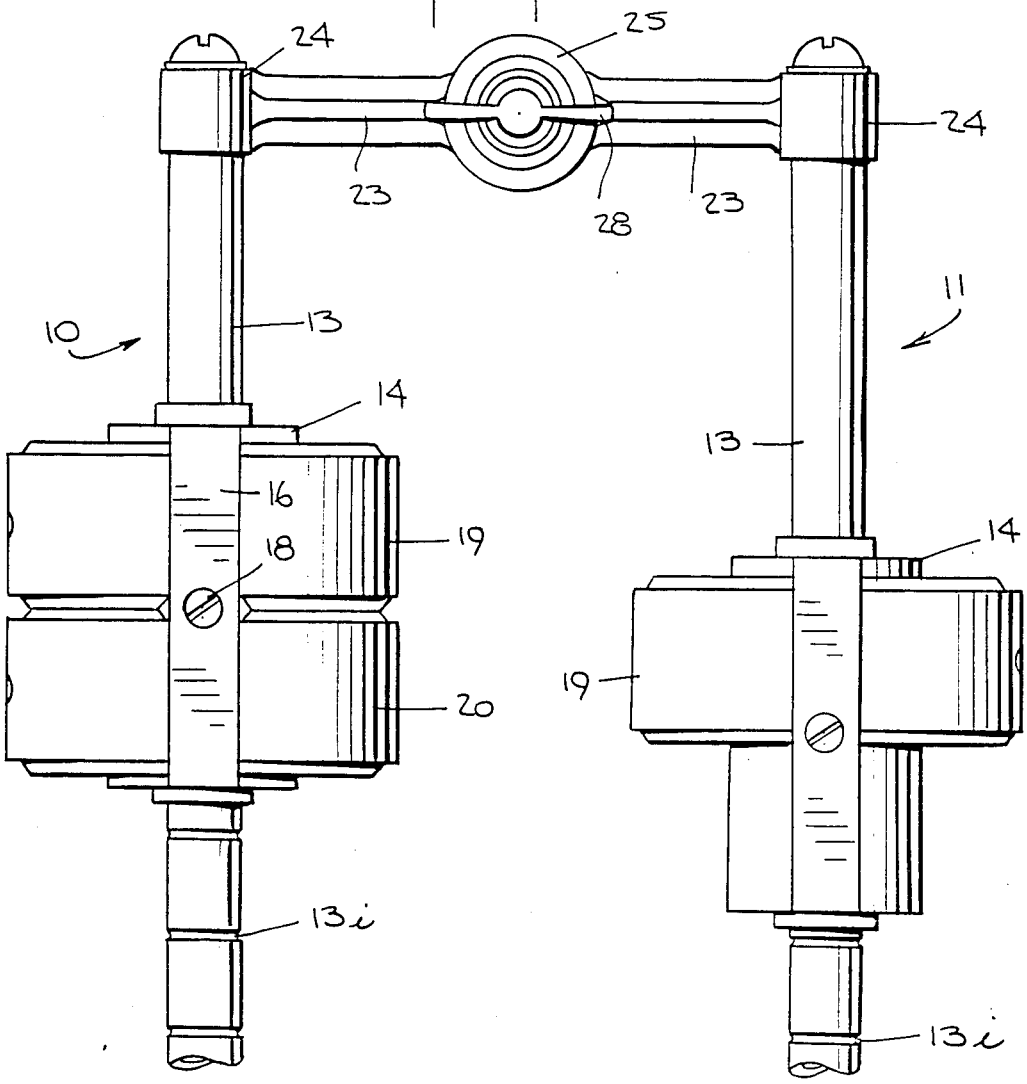
FIG. 3 is an elevational view of the exerciser with the handles omitted.
Figure 5:
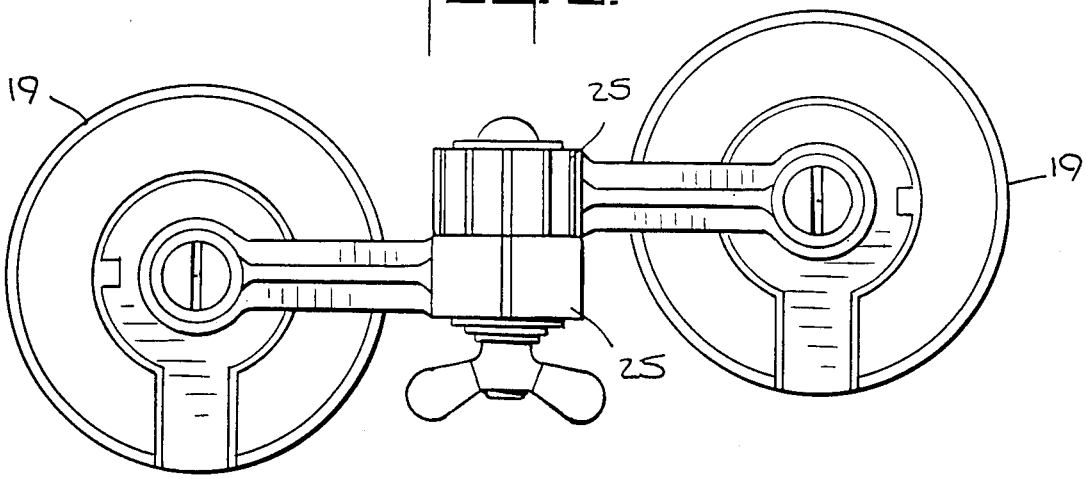
FIG. 5 is a top view of the exerciser.

Each club, as shown in FIGS. 3 and 7, includes a shaft 13 on which is slidable a carrier 14 having a cylindrical form provided with a diametrically-opposed longitudinal keyways 15 and a projection 16 having a rectangular cross section. A set screw 18 on this projection which engages shaft 13 makes it possible to lock the carrier to the shaft at any adjusted axial position.

The carrier is adapted to accommodate two annular weights 19 and 20, each having a gap 21 therein, as shown in FIG. 7, so that when a weight whose hole has the same diameter as carrier 14 is fitted endwise on the carrier, it may be locked thereto by a set screw 22 which is received in keyways 15, as shown in FIG. 9.

The carrier and the weights thereon create a mass whose axial position on shaft 13 determines the moment of inertia of the club—the closer the mass is to the far end of the shaft, the greater the moment. Since the right and left hands and arms of a typical user differ in strength, one may provide different mass adjustments for the two clubs to take this difference in strength into account. Shaft 13 is provided with circular indicia 13i to indicate the weight setting.

Each shaft 13 is provided with a lateral extension 23 having a coupling ring 24 at one end which is received on the far end of the shaft, and a second coupling ring 25 at the other end. The two coupling rings 25 are hinged together in end-to-end relation, as shown separately in FIG. 6, by means of an elastomeric bushing 26 which joins the two rings and a bolt 27 which passes through the bore in the bushing and is provided with a wing nut 28 which applies pressure to a washer 29 at one end of the bushing.

Hence, when the pressure on bushing 26 is light, little pressure is then applied thereto and the hinge is relatively free; but when the pressure is increased, the bushing is dilated to frictionally engage couplings 25 to resist hinge movement. In this way, one may set the angle between the clubs and hold this angle simply by tightening the wing nut 28, or one may loosen the wing nut to permit changing angles in the course of an exercise movement.

Figure 10:
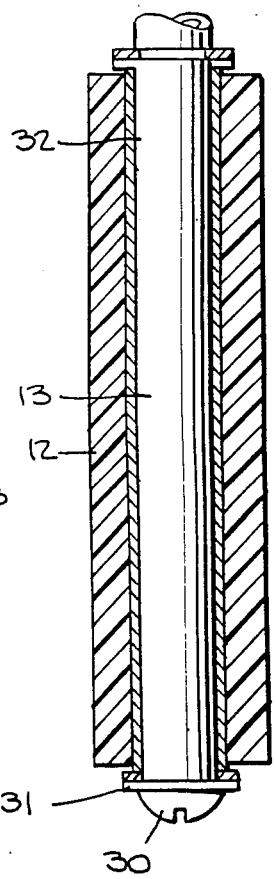

As shown in FIG. 10, each handle 12 is received at the end of shaft 13 and is held thereon by an end screw 30 and a washer 31 whose diameter is greater than that of shaft 13. Intermediate the handle and the shaft is a bearing sleeve 32 of low friction material such as Teflon (PTFE), so that one may rotate the handle.

As pointed out previously, the handle 12 removably attached to the shaft has the contour of a handle in a sports appliance, so that the user of the exerciser can apply to the exerciser a handle which simulates that of a particular sports appliance. If, therefore, the appliance is a baseball bat, the handle will have the shape shown by handle 12B in FIG. 11.

In FIG. 12, the shafts 13 of the exerciser are bridged near the handle ends by a helical spring 33 having end hooks 34 and 35 which engage loops 36 and 37 mounted on the shafts. This spring resists angular movement of the clubs in the course of exercise.

Operation

When first using the articulated exerciser, the user can adjust the weight so that the exerciser does not overtax his existing condition of muscular strength. As his condition improves with repeated exercise, he can change the weight position in accordance with his improved muscular strength.

With the clubs in parallel relation as in FIG. 1, the user can swing the exerciser up and down and execute side motions of various sorts to strengthen his arm and shoulder muscles.

With the exerciser clubs angled as shown in FIG. 2, the user can then, in the open space between the arm and hands, precess his wrists to rotate the exerciser within this space, and in doing so, not only exercise his wrist but all other muscles involved in this complex action, for the forearm bends in this motion and the muscles of the arms and shoulders are also brought into play as the weighted clubs are rotated. And while this circular motion is being executed, the user can at the same time vary the angle between the clubs. When the spring is attached, this variation in angle is resisted thereby, this action serving to exercise the elbow muscles as the elbow bends with changing angles.

Figure 13:
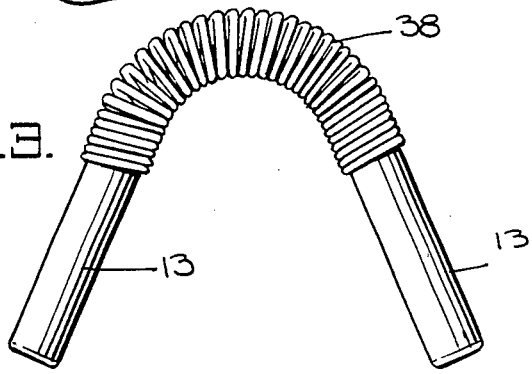
FIG. 13 shows an exerciser using a spring as the hinge.

Second Embodiment:

As shown in FIG. 13, the shafts 13 of the exerciser, instead of being hinged together with a hinge composed of two leaves interconnected by a pivot pin or by other conventional hinges may be interconnected at their ends by a helical spring 38, thereby dispensing with the extensions 23 as in the previous embodiment. In practice, the end portions of shafts 13 may be bent so that the ends are in axial alignment and are joined together by spring 38.

While there has been shown and described a preferred embodiment of an articulated hand-held exerciser in accordance with the invention, it will be appreciated that many changes and modifications may be made therein without, however, departing from the essential spirit thereof. Thus, instead of weights supported on a settable carrier, the carrier may be omitted, and the weights which are then in ring form can be slipped onto the shafts. The ring weights are provided with set screws to engage the shafts to maintain any desired axial position thereon.

I claim:

1. An articulated hand-held exerciser comprising:

A. a pair of clubs each formed by a shaft having a rotatable handle;

B. a hinge consisting of a helical spring coupled to the ends of the club shafts, the hinge and the club coupled thereto being free from any external mounting, whereby the clubs may be caused by a user to assume parallel positions or may be angled relative to the hinge to create a free space between the hands and arms of the user;

C. a mass on each shaft which is axially adjustable therein to a desired setting, whereby the user is able to manipulate the exerciser in the parallel club mode or in an angled mode in which the user can process his wrists to rotate the interhinged clubs in said space.

2. An exerciser as set forth in claim 1, wherein said handle is replaceable and is shaped to simulate the grip of a handled sports appliance.

3. An exerciser as set forth in claim 1, wherein said mass is constituted by a cylindrical carrier shiftable on said shaft, said carrier having a projection, and at least one annular weight received on said carrier, said weight having a gap to accommodate said projection.

4. An exerciser as set forth in claim 1, wherein said handle is tubular and further includes a bearing sleeve interposed between the handle and the shaft.

5. An exerciser as set forth in claim 1, further including a helical spring bridging the shafts to tension angular movement thereof with respect to said hinge.

6. An exerciser as set forth in claim 5, wherein the ends of the springs are provided with hooks to engage loops attached to the shafts whereby the spring may be attached or disconnected therefrom.

* * * * *